US006659464B1

(12) United States Patent
Champion et al.

(10) Patent No.: US 6,659,464 B1
(45) Date of Patent: Dec. 9, 2003

(54) GRIDBLOC STRATEGY GAME

(75) Inventors: Mario M. Champion, Austin, TX (US); Mark Christopher Zatopek, Austin, TX (US)

(73) Assignee: Team Smartypants!, Inc., Austin, TX (US)

( * ) Notice: Subject to any disclaimer, the term of this patent is extended or adjusted under 35 U.S.C. 154(b) by 0 days.

(21) Appl. No.: 09/696,327

(22) Filed: Oct. 25, 2000

(51) Int. Cl.[7] ..... A63F 1/00

(52) U.S. Cl. ..... 273/292; 273/236; 273/258; 273/260; 273/261; 463/14; 463/15

(58) Field of Search ..... 273/292, 258, 273/261, 236, 260; 463/14, 15

(56) References Cited

U.S. PATENT DOCUMENTS

| | | | | | |
|---|---|---|---|---|---|
| 3,807,953 | A | * | 4/1974 | Baumann | 8/491 |
| 3,844,568 | A | * | 10/1974 | Armstrong | 273/272 |
| 3,897,953 | A | * | 8/1975 | Hovnanian | 273/131 AB |
| 4,252,323 | A | * | 2/1981 | Levinrad | 273/272 |
| 4,299,578 | A | * | 11/1981 | Wayman | 273/272 |
| 4,448,423 | A | * | 5/1984 | Augusta | 273/272 |
| 4,456,261 | A | * | 6/1984 | Daitzman | 273/238 |
| 4,565,374 | A | * | 1/1986 | Pak | 273/272 |
| 4,625,971 | A | * | 12/1986 | Ferguson | 273/272 |
| 4,811,952 | A | * | 3/1989 | Dzik | 273/258 |
| 4,938,482 | A | * | 7/1990 | Ludwick et al. | 273/260 |
| 5,050,888 | A | * | 9/1991 | Schultz et al. | 273/146 |
| 5,228,699 | A | * | 7/1993 | Ludwick et al. | 273/260 |
| 5,286,030 | A | * | 2/1994 | Villagomez | 273/242 |
| 5,351,965 | A | * | 10/1994 | Telfer et al. | 273/260 |
| 5,374,065 | A | * | 12/1994 | Motskin | 273/272 |
| 5,429,371 | A | * | 7/1995 | Bledsoe | 273/243 |
| 5,445,390 | A | * | 8/1995 | Dutton et al. | 273/243 |

(List continued on next page.)

OTHER PUBLICATIONS

Killer List of Video Games, PAC–MAN, 1980, www.klov.com/P/Pac–Man.html, 1–7.*

Killer List Of Video Games, PAC–MAN, 1980, www.klov.com/P/Pac–Man.html, 1–7.*

*Primary Examiner*—Benjamin H. Layno
*Assistant Examiner*—Dolores Collins
(74) *Attorney, Agent, or Firm*—Hulsey, Calkins, Fort, Kart & Webster; Gregory K. Goshorn

(57) ABSTRACT

A GridBloc strategy game. The present invention employs a runner and a blocker within any number of various GridBloc boards. The runner is operable to move throughout the GridBloc board, and the blocker who tries to oppose the movement of the runner throughout the GridBloc board. The GridBloc structure is a three dimensional 3D volume in various embodiments of the invention. The GridBloc game is operable to be performed in the volumetric portion of the GridBloc structure. If desired, the GridBloc game is performed along the surfaces of a 3D GridBloc structure. The runners and blockers have various traits in some embodiments, including special traits that allow them to perform actions beyond a basic functionality of a runner and a blocker. The special traits are used to perform running and blocking operations a fixed number of times during the course of a game, or indefinitely throughout the game in various embodiments of the invention. Moreover, the tiles of the GridBloc structure also have variable characteristics including their respective point values in certain embodiments of the invention. If desired, when two players perform the GridBloc game in accordance with the present invention, two rounds are performed to ensure that both players have an equitable opportunity to score points. Multiple players may also play the game as well. Scoring is calculated by totalling the point values assigned each of the tiles of the GridBloc structure across which the runner has traversed. Operation of running and blocking is performed sequentially or alternatively, simultaneously.

10 Claims, 14 Drawing Sheets

U.S. PATENT DOCUMENTS 5,465,982 A * 11/1995 Rebane ..... 273/153 R
5,478,087 A * 12/1995 Dumisani ..... 273/272
5,560,611 A * 10/1996 Kim ..... 273/241
5,607,159 A * 3/1997 Bryson ..... 273/146
5,615,886 A * 4/1997 Chalfin et al. ..... 273/272
5,630,754 A * 5/1997 Rebane ..... 273/153 R
5,690,332 A * 11/1997 Rechs ..... 273/260
5,702,105 A * 12/1997 Glikmann ..... 273/156
6,098,982 A * 8/2000 Campusano ..... 273/261
6,120,029 A * 9/2000 Carmichael et al. ..... 273/260
6,170,823 B1 * 1/2001 Kintner ..... 273/236
6,196,543 B1 * 3/2001 Cornett ..... 206/315.1
6,196,545 B1 * 3/2001 Peeples ..... 273/258
6,250,633 B1 * 6/2001 Mohtasham et al. ..... 273/255
6,257,578 B1 * 7/2001 Gulliver ..... 273/236
6,276,687 B1 * 8/2001 Lenhart ..... 273/264
6,422,561 B1 * 7/2002 Schroeder ..... 273/272

* cited by examiner

GRIDBLOC STRATEGY GAME

BACKGROUND

1. Technical Field

The present invention relates generally to strategy games; and, more particularly, it relates to a strategy game employing a runner and a blocker.

2. Related Art

There is no strategy game known to the inventors that is related to the game practiced in accordance with the present invention. Further limitations and disadvantages of conventional and traditional game systems will become apparent to one of skill in the art through comparison of such systems with the present invention as set forth in the remainder of the present application with reference to the drawings.

SUMMARY OF THE INVENTION

Various aspects of the present invention can be found in a GridBloc strategy game. The GridBloc strategy game includes, among other things, a GridBloc structure having tiles. Each of the tiles has a point value. The GridBloc strategy game also includes a runner that attempts to move among selected tiles within the tiles, a blocker that employs a block to impede the movement of the runner within the GridBloc structure, and a score for the runner is calculated using point values associated with the selected tiles on over which the runner has moved.

In certain embodiments of the invention, the GridBloc strategy game terminates after the expiration of a fixed period of time. The GridBloc strategy game may also terminate when the runner has no permissible moves. The tiles are of any shape including square shapes. If desired, the tiles are of multiple shapes includes a first shape and a second shape. The runner is able to move using a special trait where the special trait includes a movement trait that is different than a basic movement trait. The blocker is also able to employ a multi-block wall to impede the movement of the runner within the GridBloc structure. The GridBloc structure includes any number of walls including an original wall.

Other aspects of the present invention can be found in a GridBloc strategy game method. The GridBloc strategy game method includes, among other things, selecting a player, selecting a running trait for the player, selecting a blocking trait for the player, selecting a grid type for a GridBloc structure. The GridBloc structure has tiles, and each of the tiles has a point value. The GridBloc strategy game method also includes selecting a trait for the grid type, and selecting a game parameter. The game parameter governs an ending of the GridBloc strategy game. The GridBloc strategy game method also includes running among the tiles, blocking within the GridBloc structure, and tallying a score. The score is calculated from point values associated with the tiles among which the running is performed.

In certain embodiments of the invention, the running and the blocking are performed sequentially. The GridBloc strategy game method also includes running among the tiles using a first trait and a second trait. The GridBloc strategy game method also includes blocking within the GridBloc structure using a first trait and a second trait. The GridBloc strategy game method also involves selecting at least one additional player. The GridBloc strategy game method allows for running among the tiles using a time varying trait. The GridBloc structure includes any number of walls including an original wall.

Other aspects of the present invention can be found in a method to play a game. The method involves running along a permissible path within tiles where each of the tiles has a point value, blocking the permissible path, and calculating a score using point values associated with the tiles of the permissible path.

In certain embodiments of the invention, the method also involves running using a special trait where the special trait includes a running trait that is different than a basic running trait. The tiles constitute a three dimensional volume in some embodiments of the inventions. If desired, some of the tiles have point values different than the remainder of the tiles. The running and the blocking can be performed simultaneously.

Other aspects, advantages and novel features of the present invention will become apparent from the following detailed description of the invention when considered in conjunction with the accompanying drawings.

BRIEF DESCRIPTION OF THE DRAWINGS

A better understanding of the present invention can be obtained when the following detailed description of various exemplary embodiments are considered in conjunction with the following drawings.

DETAILED DESCRIPTION OF THE INVENTION

Figure 1:
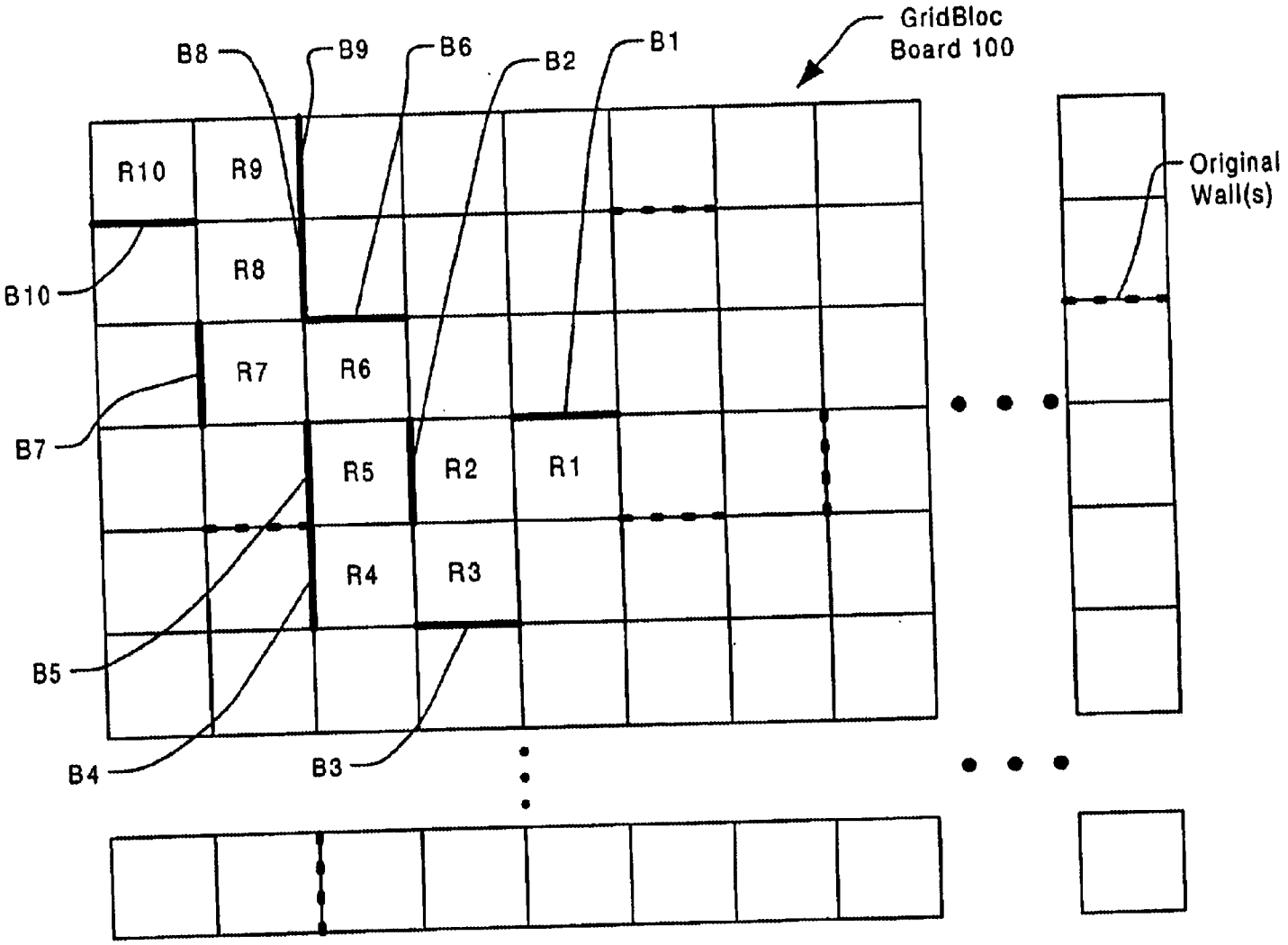
FIG. 1 is a perspective diagram illustrating an embodiment of a GridBloc board built in accordance with the present invention.

From certain perspectives, the present invention employs a game played on one or more surfaces mapped with a grid. A GridBloc board is any number of dimensions, including two dimensional 2D or three dimensional 3D, in various embodiments of the invention. In one embodiment, the present invention employs a scoring player, sometimes referred to as a runner, and a blocking player, sometimes referred to as a blocker. If desired, the present invention is performed using at least two rounds. Moreover, optional original walls are used in certain implementations of a game performed in accordance with the present invention. For example, these original walls are placed randomly along the gridlines and between orthogonally adjacent intersections within one or more of the surfaces mapped with grids.

In addition, the game is performed wherein a runner moves first and attempts to complete valid moves to as many spaces, sometimes referred to as tiles, as possible while a blocker adds additional segments. The blocker attempts to trap the bounded area so the runner may not touch new spaces and gain additional points. The runner and the blocker may move in turns, one after another, or simultaneously. The runner receives points for each successful movement. The first round can end when the blocker has built walls in such a format that the runner no longer has any freedom of movement. Alternatively, the first round can end after the expiration of a predetermined or fixed period of time. In a second round, the roles of the players are reversed. If desired for equality of starting conditions, the original walls are also included in the second round. The game is ended, in one implementation, when one player (in a single player implementation), both players (in a dual player implementation), or all players (in the case of more than one or two players) have had a turn as a runner and a blocker. One example of a single player implementation is where a user plays against a computer processor that supports the present invention. Certain profiles of former users of the system, being supported by a computer processor, are also used as the opponent of the user in other embodiments.

Winning is calculated from the total points acquired during the running operations when compared to the totals acquired by the other runners. Again, these totals are calculated within the various implementations of the present invention. For example, the totals are calculated from the fixed time period of the game or, alternatively, from the entire period before which the runner is blocked in and can make no more valid moves.

Moves, when made in the capacity of the runner, are performed as being basic moves and advanced moves. A move is also a combination of a basic move and an advanced move in certain embodiments of the invention. In a 2D square GridBloc board, a basic move is one square in any direction not blocked by one or more walls. A special trait move, or an advanced move, depends on the particular type of runner. In addition, there may also be the presence of trait-conveying objects within the GridBloc board, whether they be a 2D or a 3D GridBloc board.

As mentioned briefly above, the GridBloc board is any number of surfaces and shapes, including two dimensional 2D or three dimensional 3D surfaces mapped with a grid. For example, in one embodiment, the GridBloc board contains tiles in the shape of squares in a 9×9 square-shaped array. In general, the GridBloc surface has tiles that have sides grater than two in number. For example, as will be seen below, any number of various sided tile shapes, including GridBloc surfaces having multiple types of tile shapes within a single GridBloc surface, are all included within the scope and spirit of the invention.

Each tile represents a landing space for the runner. In one version, the GridBloc surface is walled off at each boundary, so that the runner may not run off of the edge of the GridBloc surface to escape the blocker. Also, as mentioned briefly above, any number of original walls are also included within GridBloc surface. The same original walls are used by multiple players in multi-player embodiments, or different original walls are used for each or some of the multiple players.

When multiple dimensions or a scaleable GridBloc surface is used, the runner is able to escape the blocker by leaving a portion of the GridBloc surface. If desired, the center tile is used as the starting position for the runner. Other starting positions are also used in various embodiments of the invention. In addition, the same starting position is used for multi-player embodiments, to ensure equitable starting conditions for all players, or various starting positions are used for various runners in other embodiments. The starting position variable is chosen by the runners, or randomly selected by a system on which the GridBloc game is played.

In one embodiment, game play consists of two rounds, one for each player in the capacity of runner and blocker, respectively. In a basic version, the runner is allowed to move only one block or tile at a time. The direction of allowable movements is determined by the shape of the tile in the GridBloc surface. For example, in a square tile implementation, the permissible moves are in the directions of: up, down, left, right, or diagonally. After the runner has made a move, the blocker places a new wall between any two adjacent GridBloc intersections. If desired, the blocker is allowed to place multiple walls, just as the runner is allowed to move across multiple tiles in various embodiments of the invention. Certain controls are allowed in the various GridBloc implementations. For example, in a square shaped tile embodiment, the blocker is not allowed to join diagonal intersections, but may place his wall anywhere on the board. If desired, the blocker is restricted to place a wall only adjacent to the current tile in which the runner is located. Clearly, a number of various controls of the freedom of motion of both the runner and blocker are included within the scope and spirit of the invention.

In general, the runner is not allowed to move in any direction that is blocker by a wall—either an original wall or a blocker-placed wall. The runner is not permitted to pass through a wall, absent some special trait of the runner. One goal of the runner is to step on as many different tiles as possible within the constraints of the game, be it a time pressured game or a game that is played until the runner is blocked in. The tiles all have a common point value in some embodiments of the inventions, and they have different values in other embodiments. Again, the round of the game ends when the runner has no more available moves, or the time of the round has expired.

In one embodiment, only the runner scores points for passing through certain tiles. The total for the runner is the total of all the tiles over which he has passed. In other embodiments, the blocker maintains a score based on the total of all of the tiles that the runner has failed to reach. These variations are perhaps more important in the embodiments of the invention where at least some of the tiles have different point values.

FIG. 1 is a perspective diagram illustrating an embodiment of a GridBloc board 100 built in accordance with the present invention. The GridBloc board 100 is exemplary of a 2D board, having tiles of square shape. The GridBloc board 100 is indefinitely scaleable. A number of original walls, shown in dashed lines, as placed over the surface before play begins. A runner begins at a location shown as R1. The blocker then places a wall, as shown by B1. This is a situation where the blocker places a wall immediately adjacent to the tile on which the runner is currently located. The runner then moves to a tile as shown by R2; the blocker then places a wall as shown by B2. The runner then moves to a tile as shown by R3; the blocker then places a wall as shown by B3. The runner then moves to a tile as shown by R4; the blocker then places a wall as shown by B4. The runner then moves to a tile as shown by R5; the blocker then places a wall as shown by B5. The runner then moves to a tile as shown by R6; the blocker then places a wall as shown by B6. The runner then moves to a tile as shown by R7; the blocker then places a wall as shown by B7. The runner then moves to a tile as shown by R8; the blocker then places a wall as shown by B8. The runner then moves to a tile as shown by R9; the blocker then places a wall as shown by B9. The runner then moves to a tile as shown by R10; the blocker then places a wall as shown by B10.

In an embodiment where the perimeters of the GridBloc board 100 represent boundaries through which the runner cannot navigate, then the blocker has successfully trapped the runner, and the round would end. Even in a timed embodiment, if the blocker successfully traps the runner before the expiration of the allotted time, then the round is over at that point. A bonus is given to the blocker for having blocker the runner in before the expiration of the time period. In an embodiment where play continues until the runner is blocked in, then when the runner is blocked in as shown in the tile R10, then the round is over.

As far as scoring, the total score of the runner is the total of all of the points associated with the tiles as shown in the path of the runner from R1–R10. Again, different values are used for the tiles in various embodiments of the invention. If desired, different values, penalties, or bonuses, are used when a runner re-steps over a tile that he has earlier visited in some embodiments of the inventions.

The GridBloc board 100 is illustrative of just one embodiment of movement of a runner, blocking by a blocker, and the end-game resolution functionality within a round of the GridBloc game performed in accordance with the present invention. Various other GridBloc board shapes, GridBloc board sizes, runner movements, blocker blocking techniques, and other variations are also included within the scope and spirit of the invention.

Figure 2:
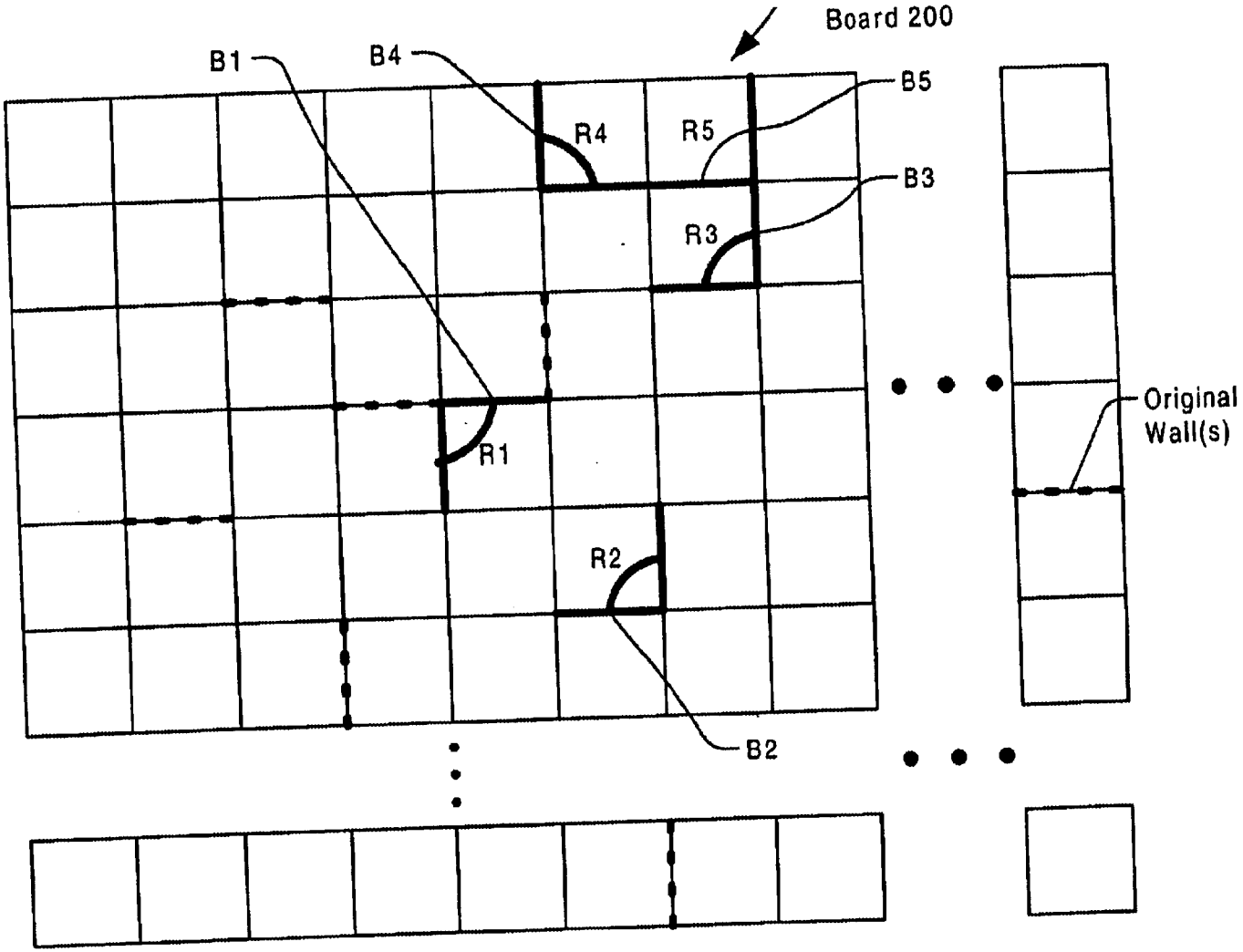
FIG. 2 is a perspective diagram illustrating another embodiment of a GridBloc board built in accordance with the present invention.

FIG. 2 is a perspective diagram illustrating another embodiment of a GridBloc board 200 built in accordance with the present invention. The GridBloc board 200 is again exemplary of a 2D board, having tiles of square shape. The GridBloc board 200 is indefinitely scaleable. A number of original walls, shown in dashed lines, are placed over the surface before play begins. A runner begins at a location shown as R1. The blocker then places a wall, as shown by B1. The wall B1 is a two-sided wall. In this situation, the wall B1 covers two sides of a square tile, where the sides are adjacent to one another. However, other blocking techniques are operable as well, such as where two walls, across from one another with respect to a tile, are also optional.

The runner then moves to a tile as shown by R2; the blocker then places a wall as shown by B2, again being a two-sided wall. The runner then moves to a tile as shown by R3; the blocker then places a wall as shown by B3, again being a two-sided wall. This movement by the runner is exemplary of a special trait move. The blocker of the FIG. 2 is provided with an advantageous blocking functionality, being able to place two-sided walls. The runner is similarly provided an ability to perform special trait moves hopefully to maintain a bit of equity in the strategy of game played in accordance with the present invention.

The runner then moves to a tile as shown by R4; the blocker then places a wall as shown by B4, again being a two-sided wall. The runner then moves to a tile as shown by R5; the blocker then places a wall as shown by B5, again being a two-sided wall.

In an embodiment where the perimeters of the GridBloc board 200 represent boundaries through which the runner cannot navigate, then the blocker has successfully trapped the runner, and the round would end. Even in a timed embodiment, if the blocker successfully traps the runner before the expiration of the allotted time, then the round is over at that point. A bonus may be given to the blocker for having blocked the runner in before the expiration of the time period. In an embodiment where play continues until the runner is blocked in, then when the runner is blocked in as shown in the tile R5, then the round is over.

As far as scoring, the total score of the runner is the total of all of the points associated with the tiles as shown in the path of the runner from R1–R5. Again, different values are used for the tiles in various embodiments of the invention. If desired, different values, penalties, or bonuses, are used when a runner re-steps over a tile that he has earlier visited in some embodiments of the inventions.

The GridBloc board 200 is illustrative of just one embodiment of movement of a runner, blocking by a blocker, and the end-game resolution functionality a round of the GridBloc game performed in accordance with the present invention. Various other GridBloc board shapes, GridBloc board sizes, runner movements, blocker blocking techniques, and other variations are also included within the scope and spirit of the invention.

Figure 3:
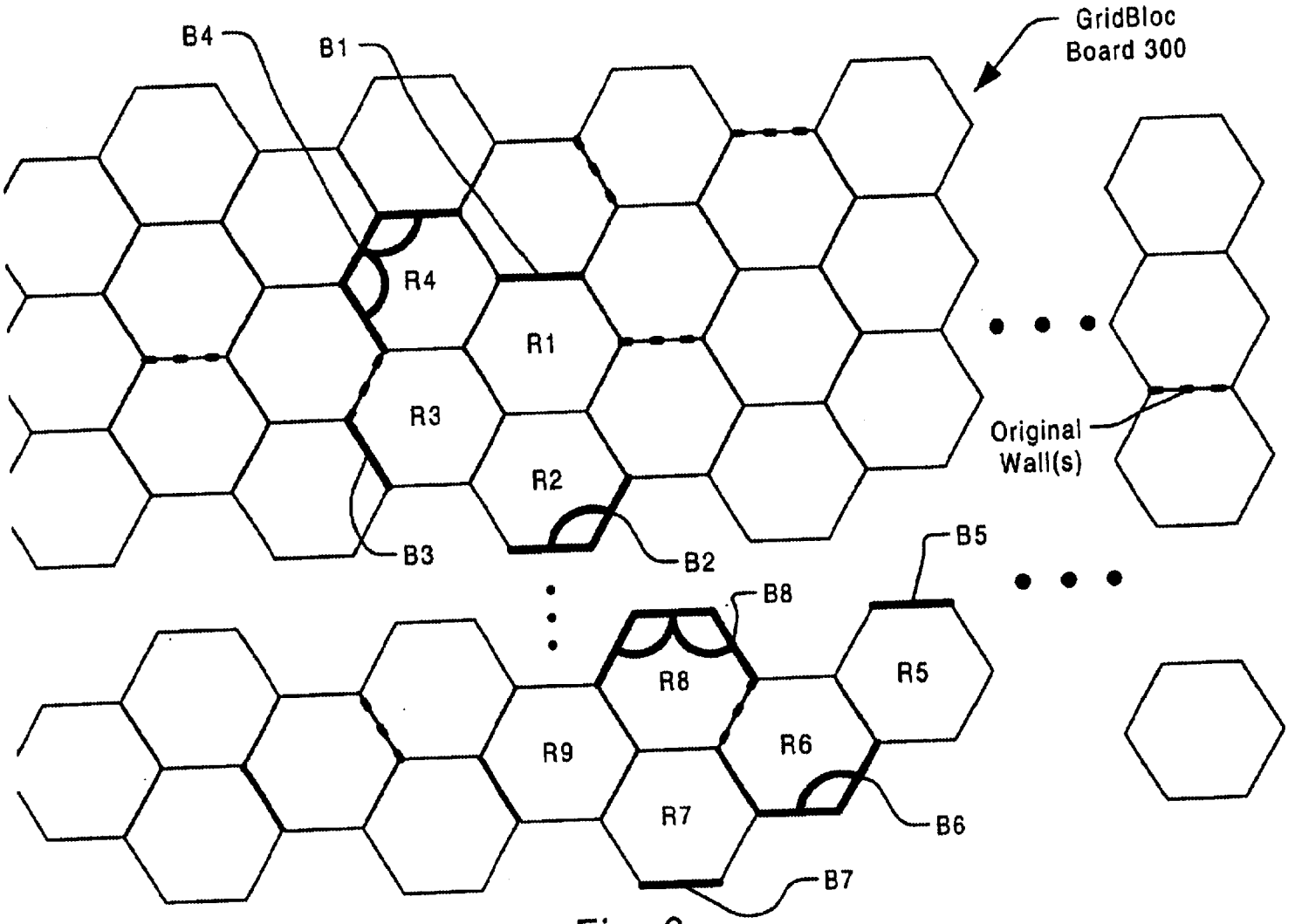
FIG. 3 is a perspective diagram illustrating another embodiment of a GridBloc board built in accordance with the present invention.

FIG. 3 is a perspective diagram illustrating another embodiment of a GridBloc board 300 built in accordance with the present invention. The GridBloc board 300 is exemplary of a 2D board, having tiles of hexagonal shape. The GridBloc board 300 is indefinitely scaleable. A number of original walls, shown in dashed lines, as placed over the surface before play begins. A runner begins at a location shown as R1. The blocker then places a wall, as shown by B1. The wall B1 is a one-sided wall located along one of the sides of the tile in which the runner initially begins. However, if desired, the blocker places a wall located anywhere on the GridBloc board 300.

The runner then moves to a tile as shown by R2; the blocker then places a wall as shown by B2, this wall being a two-sided wall along the tile in which the runner is presently located. In this situation, the wall B1 covers two sides of a hexagonal tile, where the sides are adjacent to one another. However, other blocking techniques are operable as well, such as where two walls, across from one another with respect to a tile, are also optional.

The runner then moves to a tile as shown by R3; the blocker then places a wall as shown by B3, this wall being a one-sided wall. The blocking performed as shown in the FIG. 3 shows that the characteristics and abilities of the blocker vary as a function of turns or alternatively, time, in certain embodiments of the invention. The runner then moves to a tile as shown by R4; the blocker then places a wall as shown by B4, this wall being a two-sided wall.

The runner then moves to a tile as shown by R5; the blocker then places a wall as shown by B5, this wall again being a one-sided wall. This movement by the runner is exemplary of a special trait move. The blocker of the FIG. 3 is provided with an advantageous blocking functionality, being able to place multiple-sided walls. The runner is similarly provided an ability to perform special trait moves hopefully to maintain a bit of equity in the strategy of game played in accordance with the present invention.

The runner then moves to a tile as shown by R6; the blocker then places a wall as shown by B6, again being a two-sided wall. The runner then moves to a tile as shown by R7; the blocker then places a wall as shown by B7, this wall being a one-sided wall. The runner then moves to a tile as shown by R8; the blocker then places a wall as shown by B8, this wall being a three-sided wall. The runner then moves to a tile as shown by R9.

In an embodiment where a round of the game played on the GridBloc board 300 terminates after the expiration of an amount of time. The runner has not been blocked in, yet the round terminates.

As far as scoring, the total score of the runner is the total of all of the points associated with the tiles as shown in the path of the runner from R1–R9. Again, different values are used for the tiles in various embodiments of the invention. If desired, different values, penalties, or bonuses, are used when a runner re-steps over a tile that he has earlier visited in some embodiments of the inventions.

The GridBloc board 300 is illustrative of just one embodiment of movement of a runner, blocking by a blocker, and the end-game resolution functionality a round of the GridBloc game performed in accordance with the present invention. Various other GridBloc board shapes, GridBloc board sizes, runner movements, blocker blocking techniques, and other variations are also included within the scope and spirit of the invention.

Figure 4B:
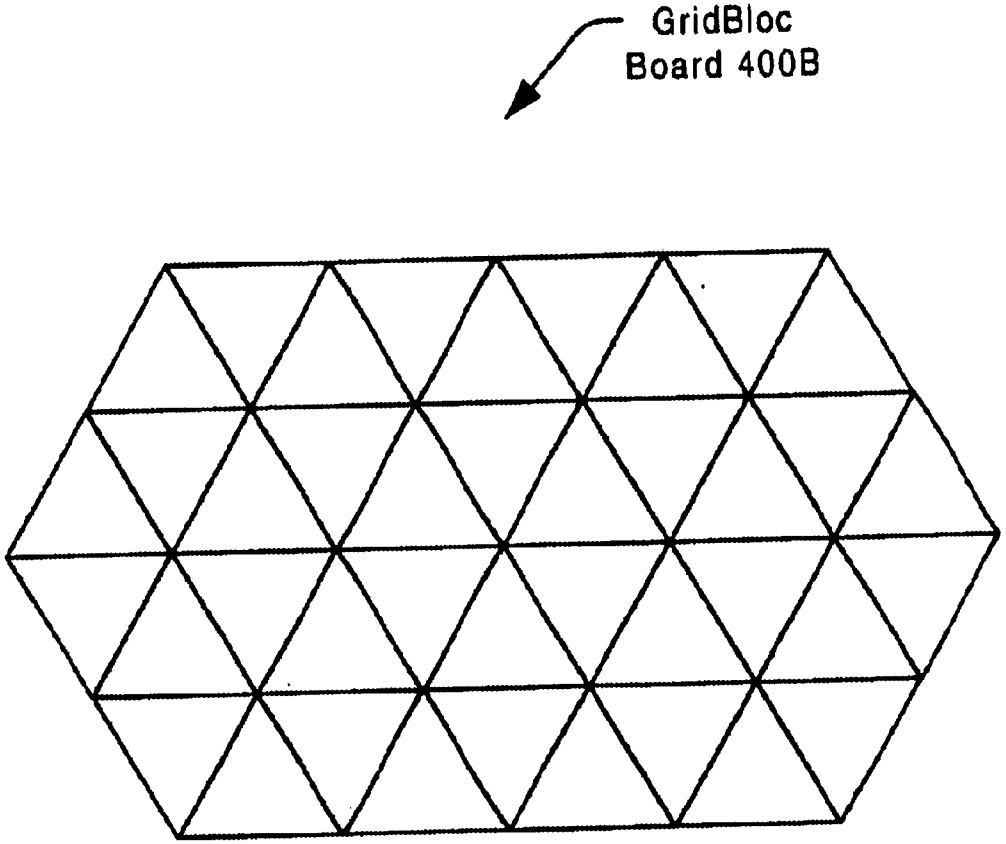
FIG. 4B is a perspective diagram illustrating another embodiment of a GridBloc board built in accordance with the present invention.
Figure 4A:
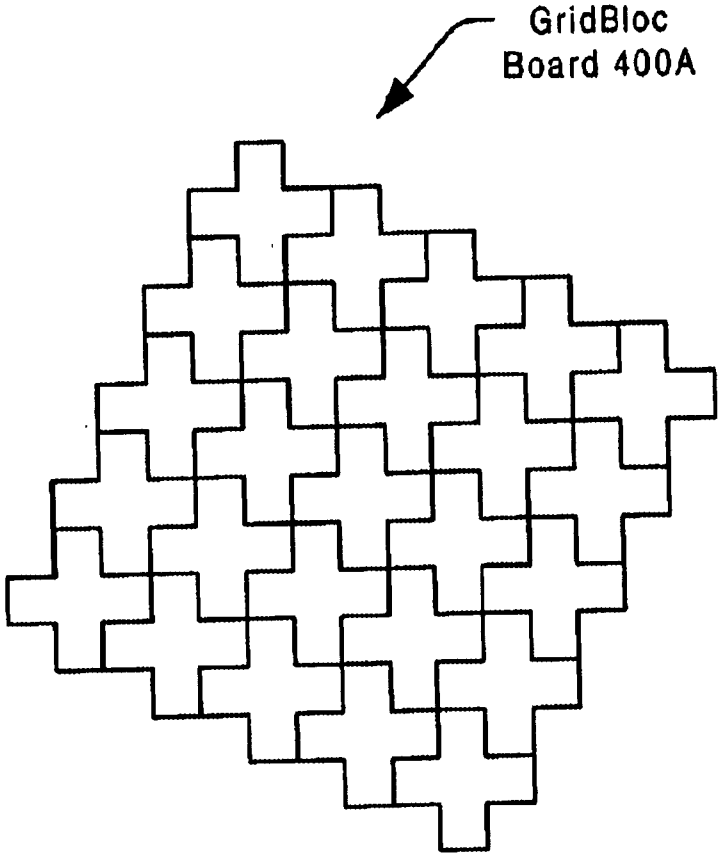
FIG. 4A is a perspective diagram illustrating another embodiment of a GridBloc board built in accordance with the present invention.

FIG. 4A is a perspective diagram illustrating another embodiment of a GridBloc board 400A built in accordance with the present invention. The GridBloc board 400A has tiles in the shape of symmetric crosses. The cross-shaped tiles are placed adjacent to one another. All of the various running and blocking options are included within the various embodiments of the invention using the GridBloc surface as shown in the FIG. 4A.

FIG. 4B is a perspective diagram illustrating another embodiment of a GridBloc board 400B built in accordance with the present invention. The GridBloc board 400B has tiles in the shape of equilateral triangles. The equilateral triangle-shaped tiles are placed adjacent to one another. All of the various running and blocking options are included within the various embodiments of the invention using the GridBloc surface as shown in the FIG. 4B.

Figure 4D:
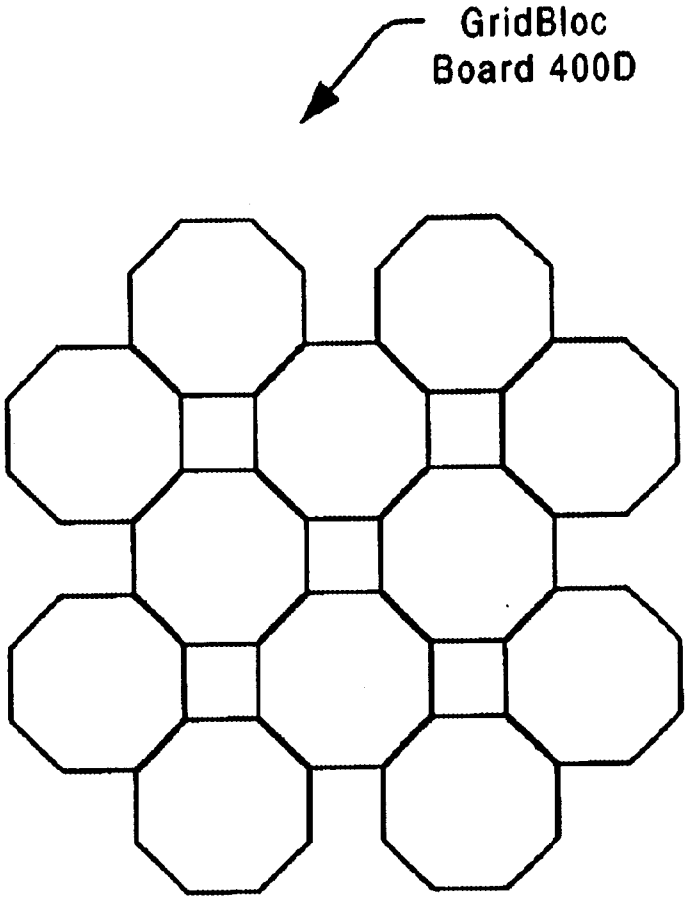
FIG. 4D is a perspective diagram illustrating another embodiment of a GridBloc board built in accordance with the present invention.
Figure 4C:
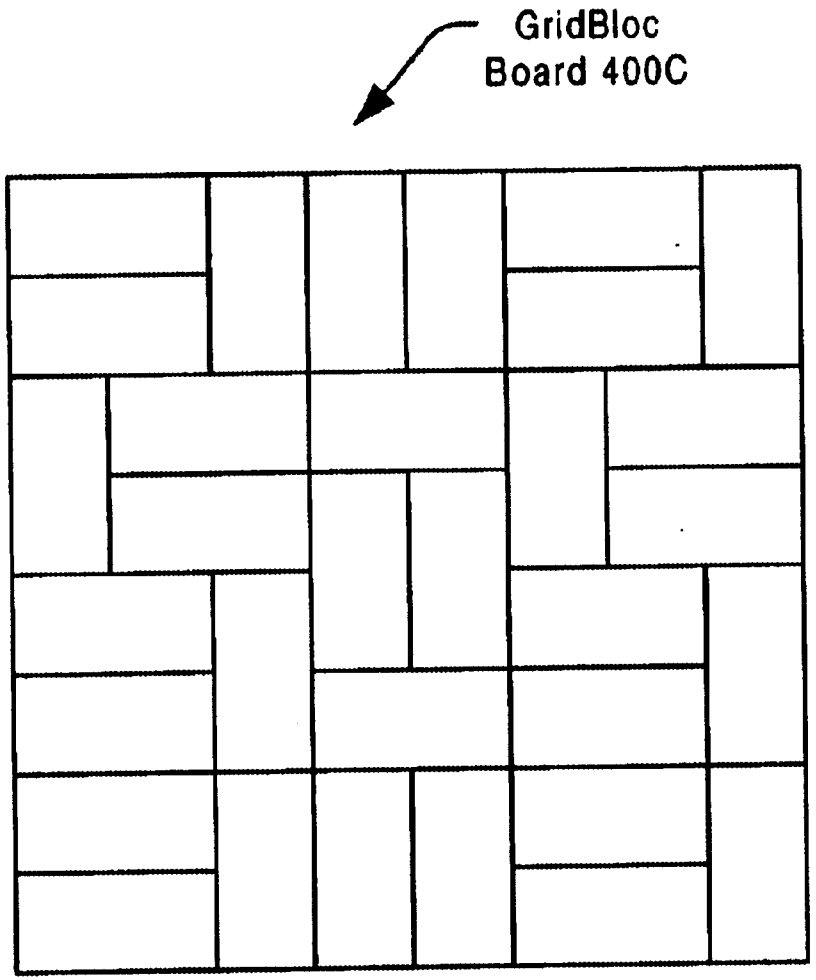
FIG. 4C is a perspective diagram illustrating another embodiment of a GridBloc board built in accordance with the present invention.

FIG. 4C is a perspective diagram illustrating another embodiment of a GridBloc board 400C built in accordance with the present invention. The GridBloc board 400C has tiles in the shape of rectangles. The rectangle-shaped tiles are placed adjacent to one another. All of the various running and blocking options are included within the various embodiments of the invention using the GridBloc surface as shown in the FIG. 4C.

FIG. 4D is a perspective diagram illustrating another embodiment of a GridBloc board 400D built in accordance with the present invention. The GridBloc board 400D has tiles in the shape of BOTH octagons and squares. The octagon-shaped tiles and the square-shaped tiles are interleaved with one another. All of the various running and blocking options are included within the various embodiments of the invention using the GridBloc surface as shown in the FIG. 4D. The embodiment shown in the FIG. 4D is where different types and various shapes of tiles are used within a single GridBloc surface. Any number of different shapes are capable to be interleaved in various embodiments of the invention, including those shapes wherein only portions of sides of the various tiles align with one another. For example, a gap, or moat as referred to in some embodiments, is included within the GridBloc surface that additionally creates some strategy of the game.

Figure 5:
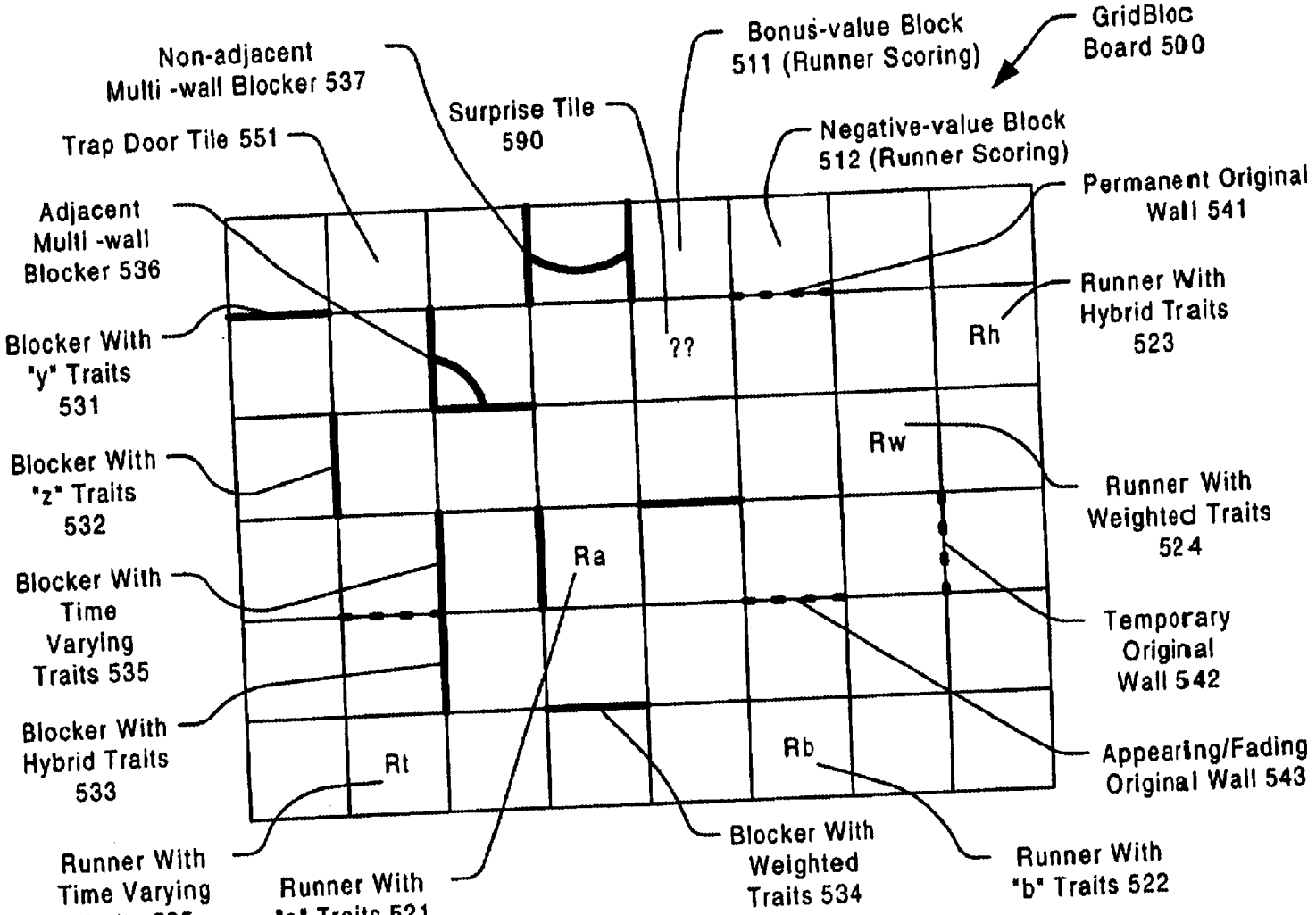
FIG. 5 is a perspective diagram illustrating various types of runners and blockers, shown on one type of GridBloc board, that are used in various embodiments of the invention.

FIG. 5 is a perspective diagram illustrating various types of runners and blockers, shown on one type of GridBloc board 500, that are used in various embodiments of the invention. Certain runners, each having different traits are shown as a runner $R_a$ with "a" traits 521 and a runner $R_b$ with "b" traits 522. These runners 521 and 522 are exemplary of runners having two different sets of traits. In one embodiment, the traits "a" and "b" both include the total number of available traits available to all runners. In another embodiment, the traits "a" and "b" are simply each sub-sets of the total number of available traits available to all runners. In even others, the traits "a" and "b" each contain some of the same traits. Another type of runner shown as $R_h$ 523 has a hybrid of traits. Also, another type of runner shown as $R_w$ 524 has a weighted set of traits. Another type of runner shown as $R_t$ 525 has a set of traits that varies as a function of time. These variations on the type of runner operable in accordance with the present invention are not exhaustive of the variations of types of runners that are used in various embodiments of the invention. If desired, the abilities of a runner can be further limited by prohibiting any backtracking within the GridBloc board 500. In other embodiments, the runner is allowed to re-trace any of his previous steps.

Similarly, certain blockers, each having different traits, are shown as a blocker with "x" traits 531 and a blocker with "z" traits 532. These blockers 531 and 532 are exemplary of blockers having two different sets of traits. In one embodiment, the traits "x" and "y" both include the total number of available traits available to all blockers. In another embodiment, the traits "x" and "y" are simply each sub-sets of the total number of available traits available to all blockers. In even others, the traits "x" and "y" each contain some of the same traits. Another type of blocker 533 has a hybrid of traits. Also, another type of blocker 534 has a weighted set of traits. Another type of blocker 535 has a set of traits that varies as a function of time. These variations on the type of blocker operable in accordance with the present invention are not exhaustive of the variations of types of blockers that are used in various embodiments of the invention. Another type of blocker is shown as the blocker 536 that is able to block multiple and adjacent walls next to a tile. Another type of blocker is shown as the blocker 537 that is able to block multiple and non-adjacent walls next to a tile.

In addition, there are multiple types of walls that are employed within various embodiments of the GridBloc board 500. For example, a permanent original wall 541 is used in some embodiments. Variations are made on some original walls, if desired. A temporary original wall 542 is used that disappears after some predetermined amount of time or predetermined number of turns of players. Also, an appearing/fading original wall 543 is used that appears and disappears as a function of time during the duration of the game.

Moreover, there are multiple kinds of tiles that are employed within various embodiments of the GridBloc board 500. For example, a trap door tile 551 is used in one embodiment to transport the runner to another location within the GridBloc board. The other locations is predetermined or random in various embodiments of the invention. A surprise tile 590 is used where neither the runner nor the blocker knows exactly what are the properties of the tile. If desired, one of the players, either the runner or the blocker, knows the property of the tile in other embodiments. The point values associated with the various tiles is also variable in certain embodiments of the invention. A bonus-value block 511 gives a runner extra points in the game, whereas a negative-value block 512 penalizes the runner for having passed over the tile. Other variations of tiles include providing for variation in the value of tiles as a function of them being used by the runner. Other variations are also included within the scope and spirit of the invention.

Figure 6:
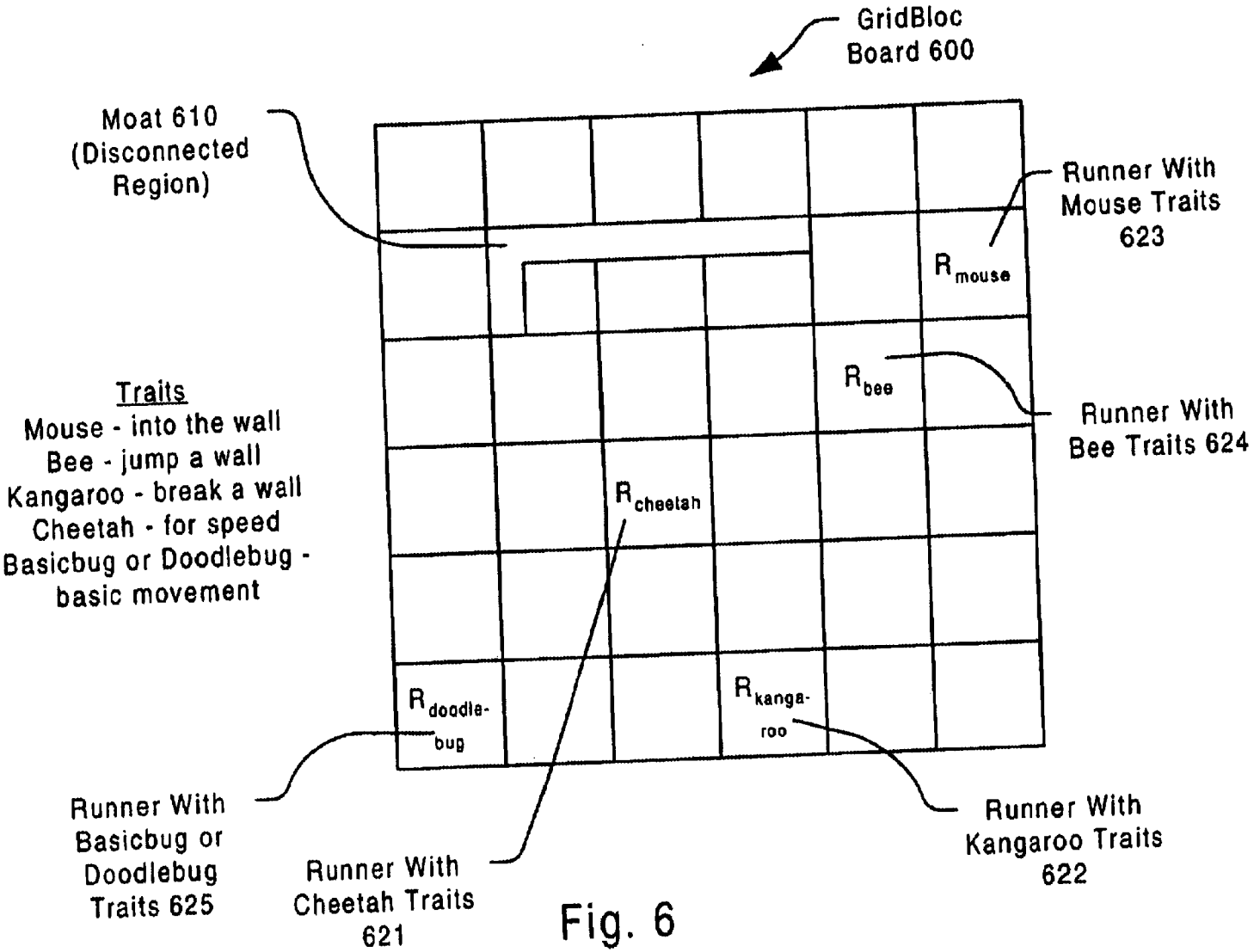
FIG. 6 is a perspective diagram illustrating other various types of runners and blockers, shown on one type of GridBloc board, that are used in various embodiments of the invention.

FIG. 6 is a perspective diagram illustrating other various types of runners and blockers, shown on one type of GridBloc board 600, that are used in various embodiments of the invention. The FIG. 6 shows some runners having special traits as mentioned above in various embodiments of the invention.

A runner $R_{mouse}$ 623 has an ability to pass into a wall. The runner $R_{mouse}$ 623 is able to create a "mousehole" into an edging wall and move through contiguous walls exiting into any other directly edged tile. The runner $R_{mouse}$ 623 is unable to enter or exit through the "end" of a wall. If desired, the number of times such a special trait may be used is limited to a predetermined number of times within a given game.

A runner $R_{bee}$ 624 has an ability to jump a wall. The runner $R_{bee}$ 624 is able to move from any tile to any other tile regardless of the wall configuration. One example of the movement of the runner $R_{bee}$ 624 is when the runner is completely enclosed by walls. The runner $R_{bee}$ 624 then invokes its special power and "flies" free to any other tile. If desired, the number of times such a special trait may be used is limited to a predetermined number of times within a given game.

A runner $R_{kangaroo}$ 622 has an ability to break down a wall. The runner $R_{kangaroo}$ 622 has an ability to knock down a wall, either temporarily or permanently, and then proceed to a next tile where it performs a regular move. Again, the number of times this speacial trait may be used is limited in certain embodiments of the invention. If desired, the number of times such a special trait may be used is limited to a predetermined number of times within a given game.

A runner $R_{cheetah}$ 621 has an ability to move very quickly. The runner $R_{cheetah}$ 621 moves several spaces in a single movement in certain embodiments of the invention. If desired, the total number of tiles across which the runner $R_{cheetah}$ 621 is allowed to move is controlled or fixed to a predetermined number of tiles. It is variable in other embodiments, such as a function of the total number of accumulated points that the runner $R_{cheetah}$ 621 currently has. If desired, the number of times such a special trait may be used is limited to a predetermined number of times within a given game.

A runner $R_{basicbug}$ 625 or a $R_{doodlebug}$ 625 has an ability to move at the most basic level offered in accordance with the present invention. For example, in one embodiment in a GridBloc board having square shaped tiles, the runner $R_{basicbug}$ 625 or a $R_{doodlebug}$ 625 is able only to move one block at a time in a given turn.

The GridBloc board 600 shows another variation of a GridBloc board used in the present invention. A moat 610, or a disconnected region further complicates the structure on which the which the game is played. A blocker uses the moat 610 as another defensive position in trying to trap the runner. The runner must similarly be aware of the moat 610. From one perspective, the moat 610 is viewed as being a continuum of original walls. Another variation of a blocking option is to allow the blocker to add various moats, in addition to the various types of walls allows within the scope and spirit of the invention.

Figure 7:
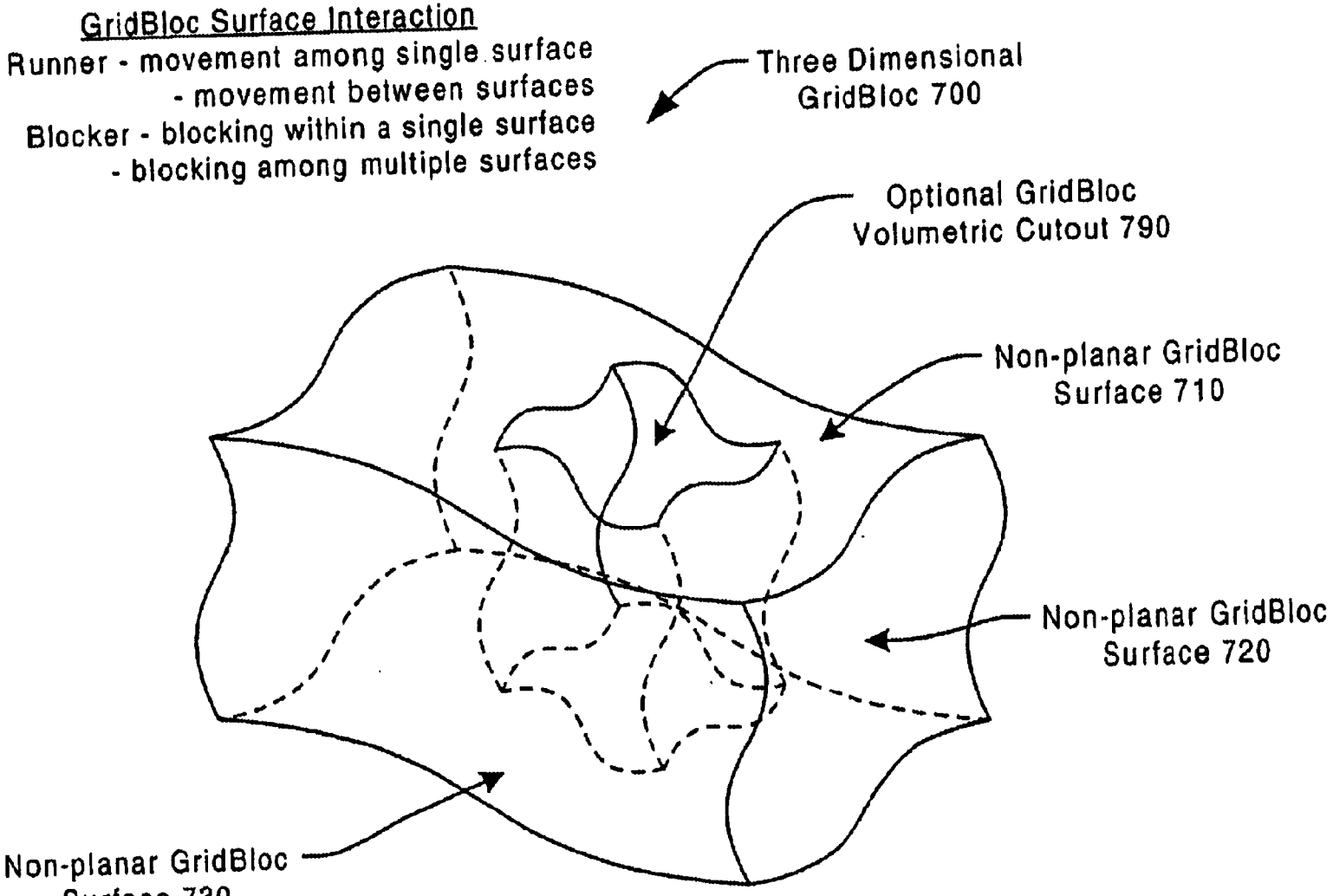
FIG. 7 is a perspective diagram illustrating an embodiment of a three dimensional GridBloc built in accordance with the present invention.

FIG. 7 is a perspective diagram illustrating an embodiment of a three dimensional 3D GridBloc 700 built in accordance with the present invention. The 3D GridBloc 700 is exemplary of an embodiment of the invention having multiple surfaces. Various types of surfaces are used in the 3D GridBloc 700. A non-planar GridBloc surface 710, a non-planar GridBloc surface 720, and a non-planar GridBloc surface 730 are all part of the GridBloc 700. Multiple other sides complete this particular implementation of the GridBloc 700 to enclose a volume. Some of the sides of a GridBloc are planar in certain embodiments of the invention. If desired, both interior and exterior sides of the various surfaces of the GridBloc 700 are used to employ grids having tiles that are used for runner and blocker interaction in accordance with the present invention.

The GridBloc surface interaction includes the runner moving among a single surface or alternatively among different surfaces of the GridBloc 700. For example, a runner is able to move from the non-planar GridBloc surface 710 to the non-planar GridBloc surface 720 and to the non-planar GridBloc surface 730. Similarly, a blocker is able to block within a single surfaces of the GridBloc 700 or alternatively among different surfaces of the GridBloc 700. For example, a blocker may choose to place a single wall block on only one surface of the GridBloc 700. In an embodiment where the blocker is permitted to place more than one wall at a time, the blocker may choose to place one wall on one of the surfaces and another wall on another one of the surfaces.

In addition, an optional volumetric cutout 790 is cut out of the center of the GridBloc 700. Such a cutout not only further limits the various surfaces of the GridBloc 700, but it also generates additional surfaces on which various runners and blockers interact.

Moreover, the playing the game in accordance with the present invention is performed not only among the various surfaces of the GridBloc 700, but also within the interior volume of the GridBloc 700. For example, a 3D game volume is employed instead of solely the 2D surfaces of the GridBloc 700.

Figure 8:
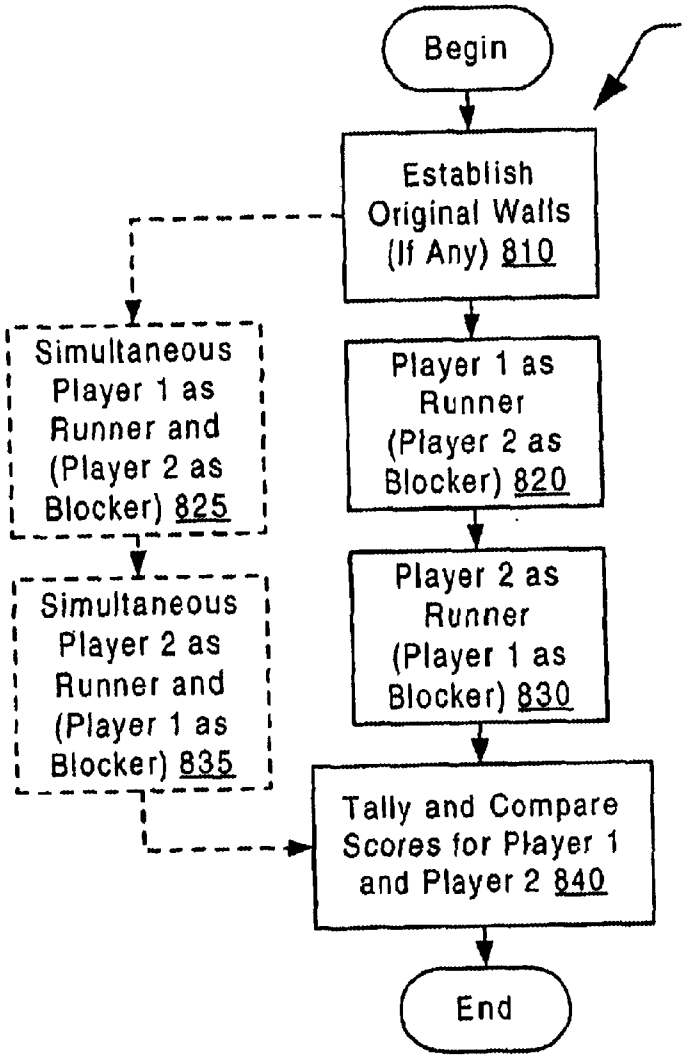
FIG. 8 is a functional block diagram illustrating an embodiment of a GridBloc game method performed in accordance with the present invention.

FIG. 8 is a functional block diagram illustrating an embodiment of a GridBloc game method 800 performed in accordance with the present invention. In a block 810, any original walls to be placed within a GridBloc board or GridBloc volume are established. Again as described above in various embodiments of the invention, the original walls are the same for multiple players in some embodiments of the inventions, and they are different for each or some of the multiple players in other embodiments. In a block 820, a player 1 operates as runner and a player 2 operates as a blocker. In single player embodiments, one of the player 1 and the player 2 is chosen as the computer run player. For example, the user is able to choose to be the runner or the blocker first. Subsequently, in a block 830, the player 2 operates as runner and a player 1 operates as a blocker. Finally, in a block 840, the scores of both the player 1 and the player 2 are tallied and compared. The player with the highest points total is deemed the winner.

If desired, instead of performed sequential operations of both run and block between the runner and the blocker as shown in the blocks 820 and 830, the player 1 operates as runner and the player 2 operates as a blocker simultaneously as shown in a block 825. Subsequently, the player 2 operates as runner and the player 1 operates as a blocker simultaneously as shown in a block 835.

Figure 9:
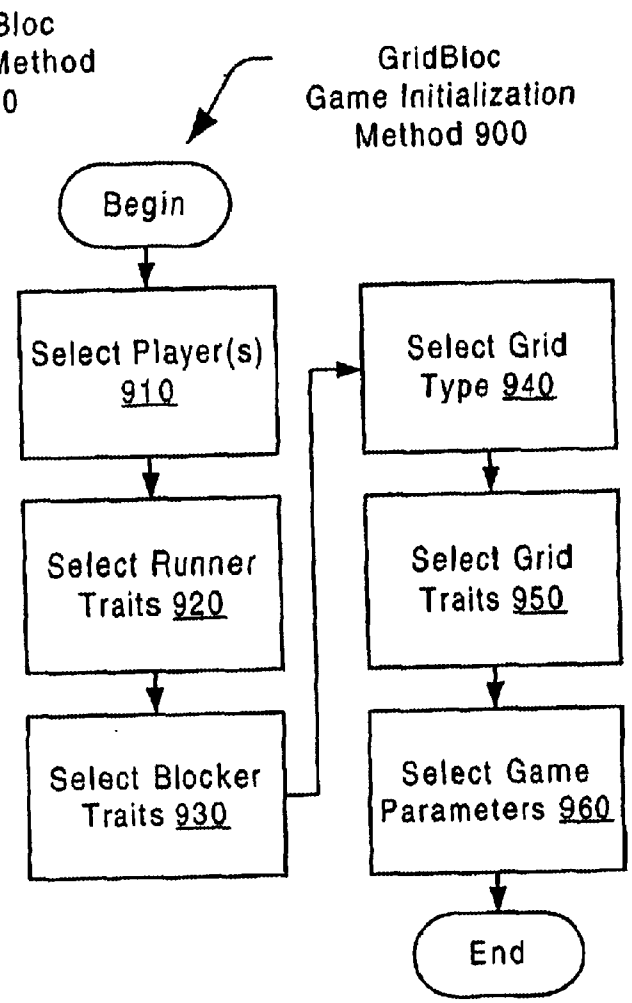
FIG. 9 is a functional block diagram illustrating an embodiment of a GridBloc game initialization method performed in accordance with the present invention.

FIG. 9 is a functional block diagram illustrating an embodiment of a GridBloc game initialization method 900 performed in accordance with the present invention. In a block 910, the players of the GridBloc game are selected. As described above in many of the various embodiments of the invention, one player (in a single player implementation), two players (in a dual player implementation), or all players (in the case of more than one or two players) are selected to have a turn as a runner and a blocker. In a block 920 and a block 930, respectively, the traits of the players are selected. This selection is for one or both of the blocker and the runner traits. Many varieties of runners and blockers are included within the scope and spirit of the invention. Any of the particular traits of runner and blocker enumerated above in the various Figures are selected, or traits not enumerated above are selected in the blocks 920 and 930.

Then, in a block 940, the grid type for the GridBloc is selected. Many varieties of GridBloc surfaces have been disclosed in various embodiments of the invention. The grid type selected in the block 940 is any one of the GridBloc board surfaces described in the various embodiments of the invention, or a grid type not specifically disclosed is selected. In addition, in a block 950, the traits of the selected grid are selected. There are variations not only in the physical configuration of the shapes and sizes of the grids, but the various tiles of the GridBloc have characteristics that are also selectable. Then, in a block 960, the game parameters are selected. Examples of the game parameters include whether to perform the GridBloc game until the runner is blocked in by the blocker, or until a predetermined amount of time has expired, or until a predetermined number of turns by either one or both of the runner and the player have been performed.

Figure 10:
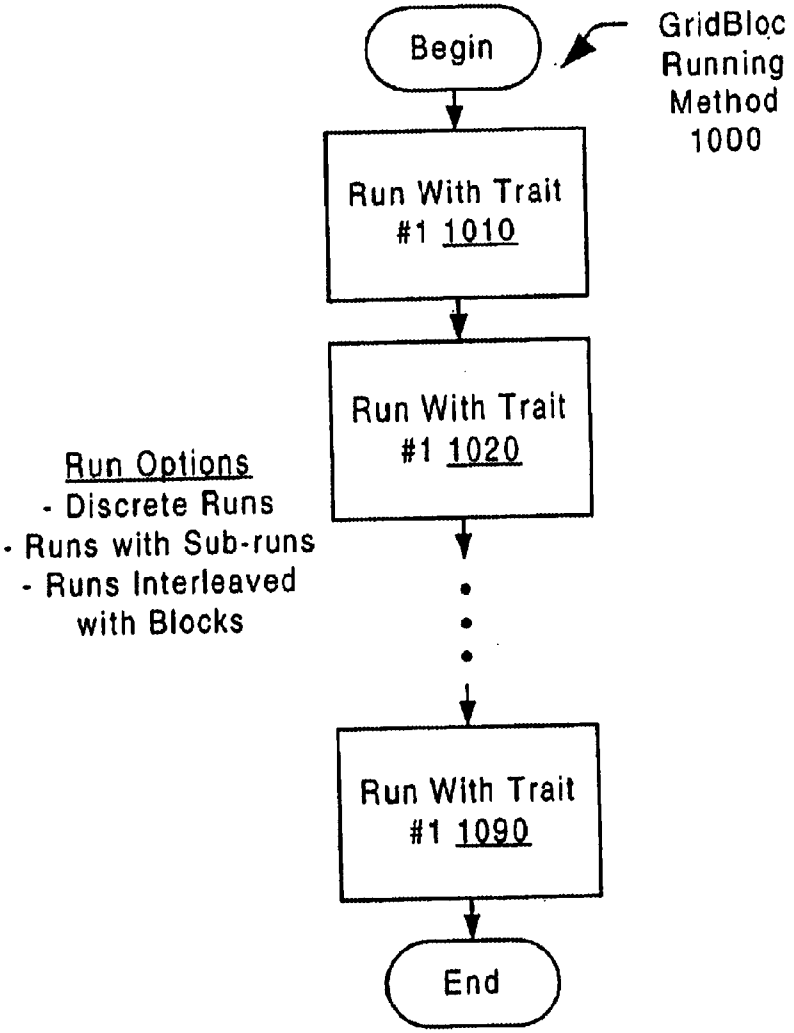
FIG. 10 is a functional block diagram illustrating an embodiment of a GridBloc running method performed in accordance with the present invention.

FIG. 10 is a functional block diagram illustrating an embodiment of a GridBloc running method 1000 performed in accordance with the present invention. In a block 1010, running is performed using a trait #1. Then, in a block 1020, running is again performed using the trait #1.

After an indefinite number of runs have been performed, in a block 1090, then running is performed with the trait #1. Running is performed using various options including performing discrete runs, runs within sub-runs, or runs being interleaved with blocks.

Figure 11:
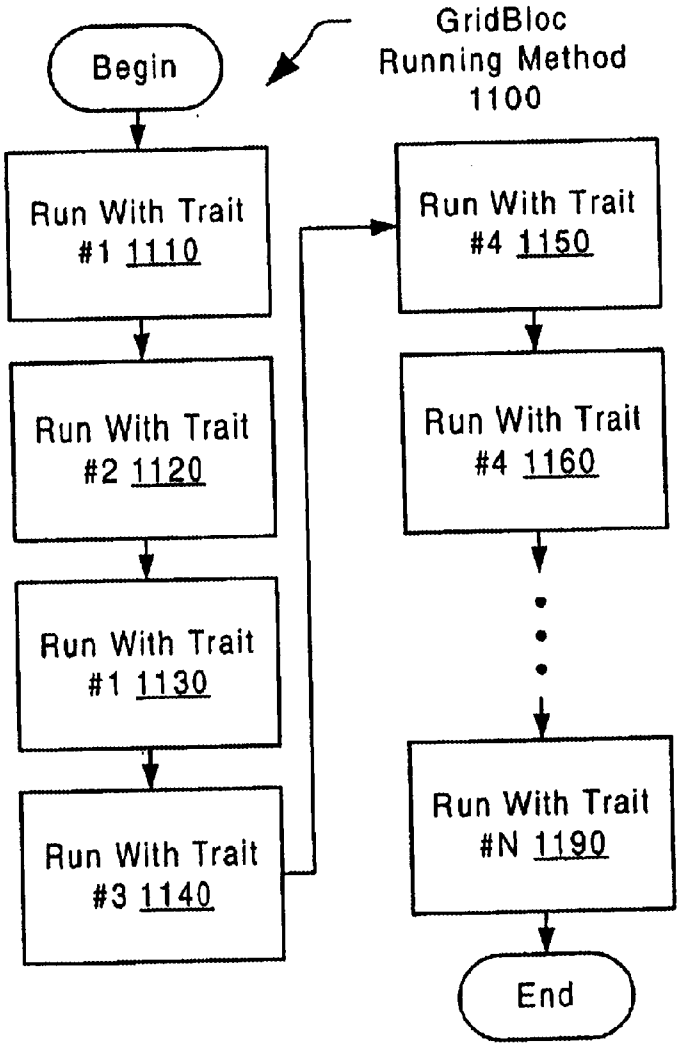
FIG. 11 is a functional block diagram illustrating another embodiment of a GridBloc running method performed in accordance with the present invention.

FIG. 11 is a functional block diagram illustrating another embodiment of a GridBloc running method 1100 performed in accordance with the present invention. In a block 1110, running is performed using a trait #1. Then, in a block 1120, running is performed using a trait #2. Then, in a block 1130, running is again performed using the trait #1. Then, in a block 1140, running is performed using a trait #3. Then, in a block 1150, running is performed using a trait #4. Then, in a block 1160, running is again performed using the trait #4. After an indefinite number of runs have been performed, in a block 1190, then running is performed with the trait #N. Running is performed using various options including performing discrete runs, runs within sub-runs, or runs being interleaved with blocks.

The FIG. 11 is illustrative of a situation where running is performed using different special traits in different running attempts. As shown in the FIG. 11, the traits of the runner are capable to be modified with respective turns, and the various traits are capable to be interleaved with one another in some embodiments of the inventions.

Figure 12:
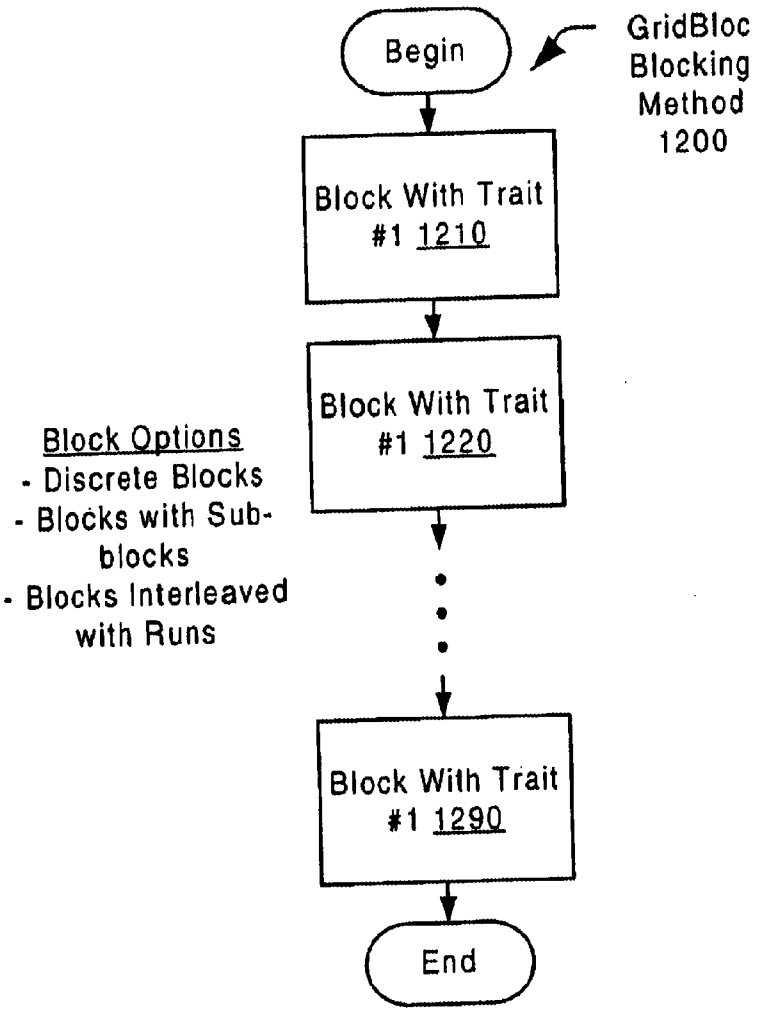
FIG. 12 is a functional block diagram illustrating an embodiment of a GridBloc blocking method performed in accordance with the present invention.

FIG. 12 is a functional block diagram illustrating an embodiment of a GridBloc blocking method 1200 performed in accordance with the present invention. In a block 1210, blocking is performed using a trait #1. Then, in a block 1220, blocking is again performed using the trait #1. After an indefinite number of blocks have been performed, in a block 1290, then blocking is performed with the trait #1. Blocking is performed using various options including performing discrete blocks, runs within sub-blocks, or blocks being interleaved with runs.

Figure 13:
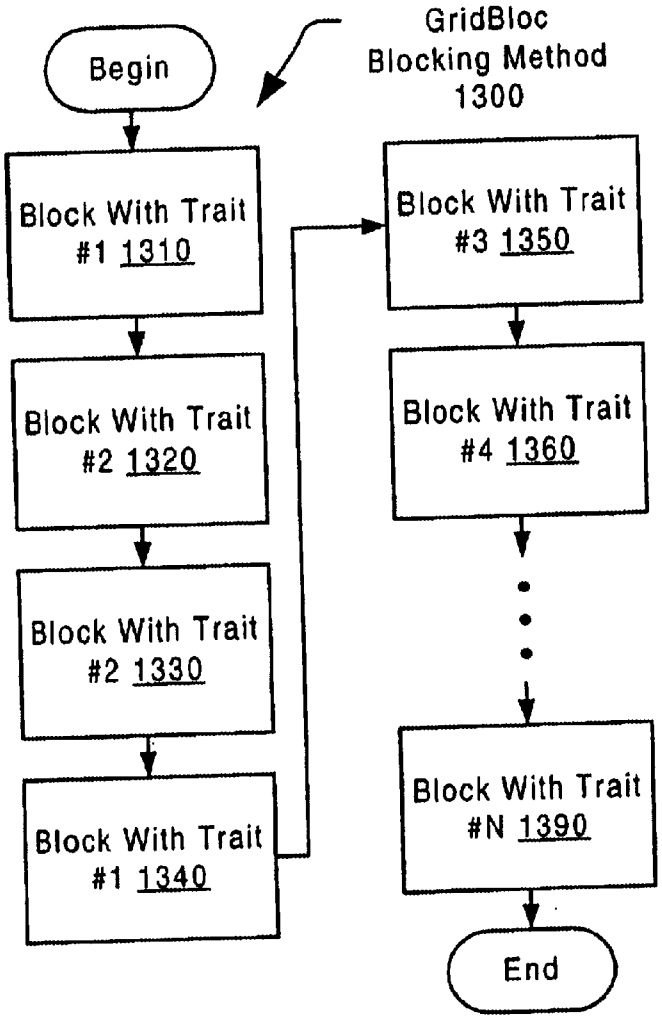
FIG. 13 is a functional block diagram illustrating another embodiment of a GridBloc blocking method performed in accordance with the present invention.

FIG. 13 is a functional block diagram illustrating another embodiment of a GridBloc blocking method performed in accordance with the present invention. In a block 1310, blocking is performed using a trait #1. Then, in a block 1320, blocking is performed using a trait #2. Then, in a block 1330, blocking is again performed using the trait #2. Then, in a block 1340, blocking is performed again using the trait #1. Then, in a block 1350, blocking is performed using a trait #3. Then, in a block 1360, blocking is performed using a trait #4. After an indefinite number of blocks have been performed, in a block 1390, then blocking is performed with the trait #N. Blocking is performed using various options including performing discrete blocks, blocks within sub-blocks, or blocks being interleaved with runs.

The FIG. 13 is illustrative of a situation where blocking is performed using different special traits in different blocking attempts. As shown in the FIG. 13, the traits of the blocker are capable to be modified with respective turns, and the various traits are capable to be interleaved with one another in some embodiments of the inventions.

Figure 14:
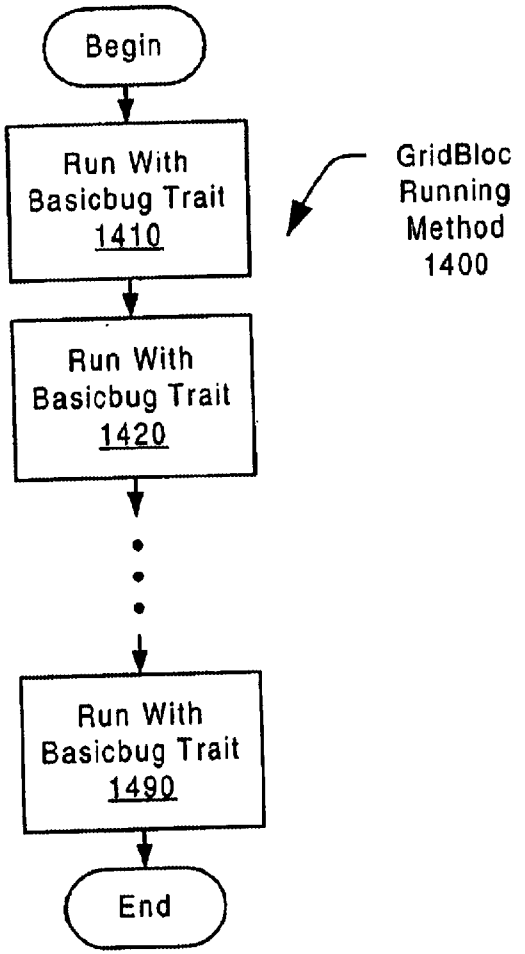
FIG. 14 is a functional block diagram illustrating another embodiment of a GridBloc running method performed in accordance with the present invention.

FIG. 14 is a functional block diagram illustrating another embodiment of a GridBloc running method 1400 performed in accordance with the present invention. In a block 1410, running is performed using a basicbug trait. Then, in a block 1420, running is again performed using the basicbug trait. After an indefinite number of runs have been performed, in a block 1490, then running is performed with the basicbug trait. Running is performed using various options including performing discrete runs, runs within sub-runs, or runs being interleaved with blocks.

Figure 15:
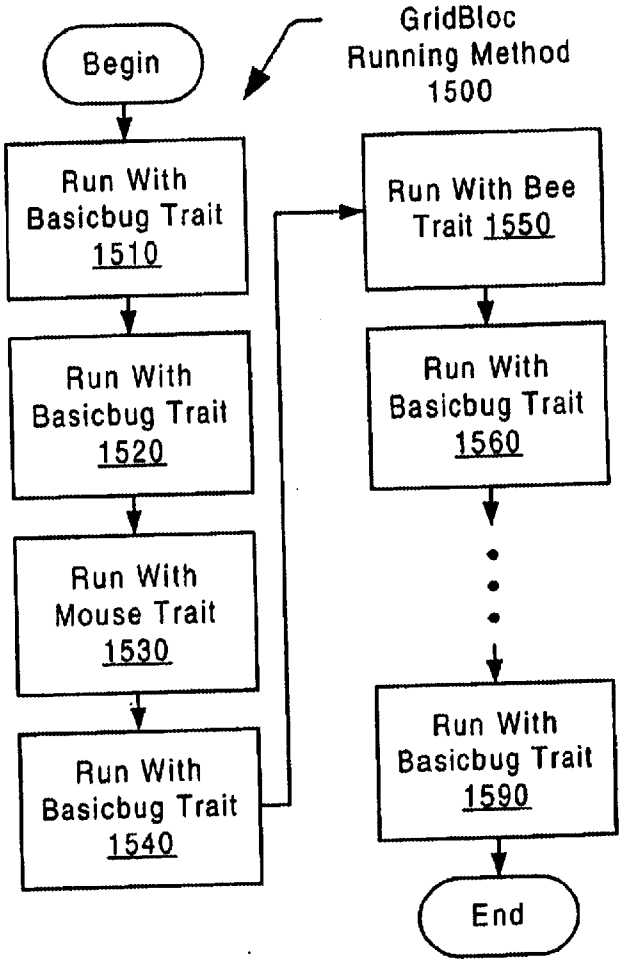
FIG. 15 is a functional block diagram illustrating another embodiment of a GridBloc running method performed in accordance with the present invention.

FIG. 15 is a functional block diagram illustrating another embodiment of a GridBloc running method 1500 performed in accordance with the present invention. In a block 1510, running is performed using a basicbug trait. Then, in a block 1520, running is performed using the basicbug trait. Then, in a block 1530, running is performed using a mouse trait. Then, in a block 1540, running is performed using the basicbug trait. Then, in a block 1550, running is performed using a bee trait. Then, in a block 1560, running is again performed using the basicbug trait. After an indefinite number of runs have been performed, in a block 1590, then running is performed with the basicbug trait. Running is performed using various options including performing discrete runs, runs within sub-runs, or runs being interleaved with blocks.

The FIG. 15 is illustrative of a situation where running is performed using different special traits in different running attempts. As shown in the FIG. 15, the traits of the runner are capable to be modified with respective turns, and the various traits are capable to be interleaved with one another in some embodiments of the inventions. While the specific examples of the basicbug traits, the bee traits, and the mouse traits have been enumerated, any other of the special traits enumerated within the various embodiments of the invention are also included within the scope and spirit of the invention.

Figure 16:
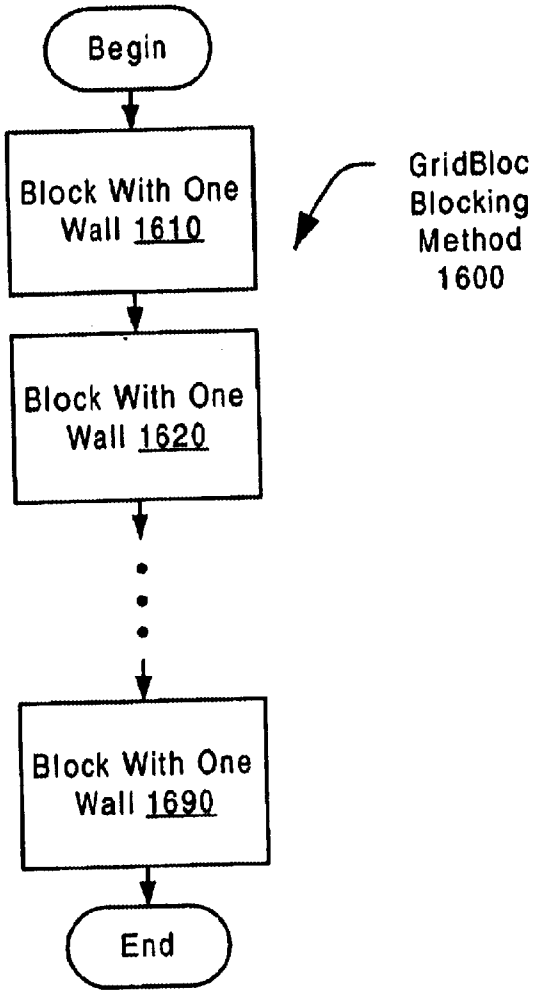
FIG. 16 is a functional block diagram illustrating another embodiment of a GridBloc blocking method performed in accordance with the present invention.

FIG. 16 is a functional block diagram illustrating another embodiment of a GridBloc blocking method 1600 performed in accordance with the present invention. In a block 1610, blocking is performed using one wall. Then, in a block 1620, blocking is again performed using one wall. After an indefinite number of blocks have been performed, in a block 1690, then blocking is performed using one wall. Blocking is performed using various options including performing discrete blocks, runs within sub-blocks, or blocks being interleaved with runs.

Figure 17:
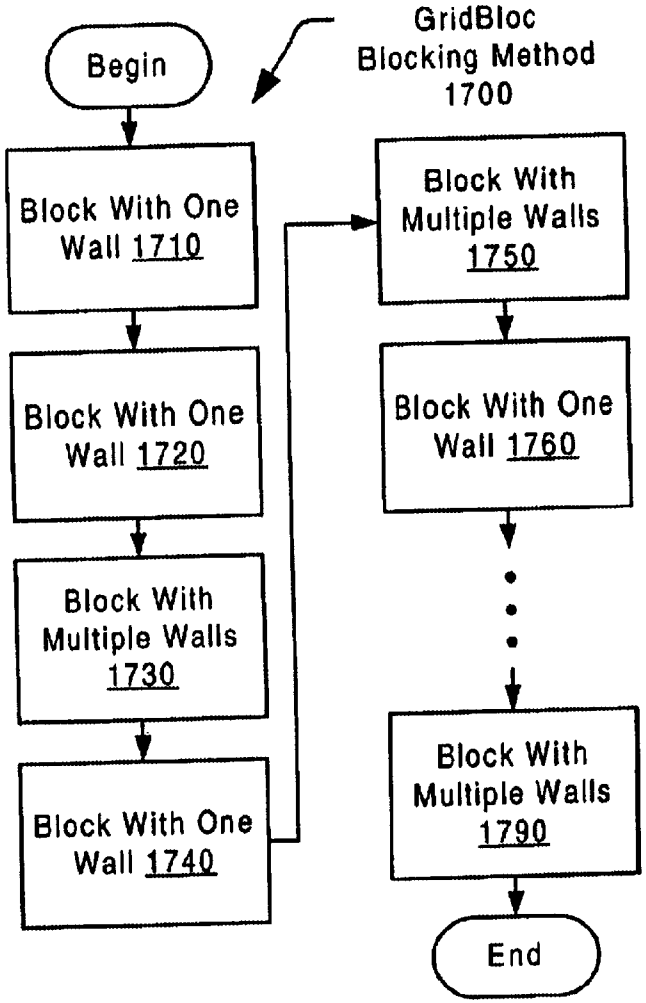
FIG. 17 is a functional block diagram illustrating another embodiment of a GridBloc blocking method performed in accordance with the present invention.

FIG. 17 is a functional block diagram illustrating another embodiment of a GridBloc blocking method 1700 performed in accordance with the present invention. In a block 1710, blocking is performed using one wall. Then, in a block 1720, blocking is again performed using one wall. Then, in a block 1730, blocking is performed using multiple walls. Then, in a block 1740, blocking is performed again using one wall. Then, in a block 1750, blocking is performed using multiple walls. Then, in a block 1760, blocking is performed using a one wall. After an indefinite number of blocks have been performed, in a block 1790, then blocking is performed with multiple walls. Blocking is performed using various options including performing discrete blocks, blocks within sub-blocks, or blocks being interleaved with runs.

The FIG. 17 is illustrative of a situation where blocking is performed using different special traits in different blocking attempts. As shown in the FIG. 17, the traits of the blocker are capable to be modified with respective turns, and the various traits are capable to be interleaved with one another in some embodiments of the inventions.

Figure 18:
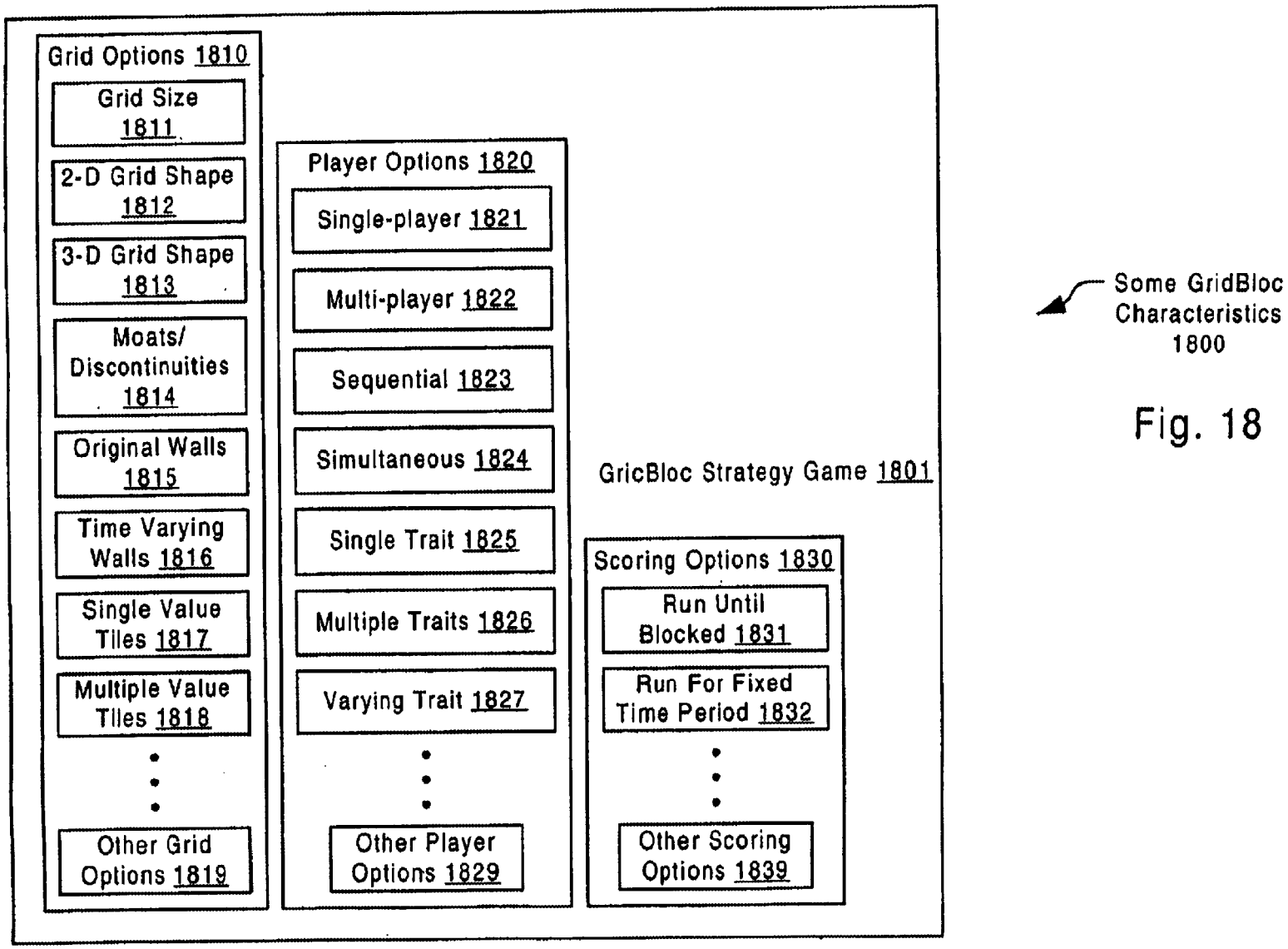
FIG. 18 is a perspective diagram illustrating some GridBloc characteristics employed in various embodiments of the invention.

FIG. 18 is a perspective diagram illustrating some GridBloc characteristics 1800 employed in various embodiments of the invention. The GridBloc characteristics 1800 are shown, from one perspective, as being parts of a GridBloc strategy game 1801. The GridBloc strategy game 1801 itself contains, among other things, grid options 1810, player options 1820, and scoring options 1830.

The grid options 1820 include, among other things, a grid size 1811, a 2-D grid shape 1812, a 3-D grid shape 1813, moats/discontinuities 1814, original walls 1815, time varying walls 1816, single value tiles 1817, multiple value tiles 1818, and other grid options 1819.

The player options include, among other things, those of a single player 1821, a multi-player 1822, sequential operation 1823 of one or both or running and blocking, simultaneous operation 1824 of one or both or running and blocking, runners or blockers with a single trait 1825, runners or blockers with multiple traits 1826, runners or blockers with a varying trait 1827, and other player options 1829. The scoring options include, among other things, running until blocked 1831, running for a fixed period of time 1832, and other scoring options 1839.

A game performed in accordance with the present invention is employed using any number of techniques. For example, the present invention is operable to be performed simply using a paper and pen or pencil. A hand operated implementation of the present invention is performed in such a manner. More sophisticated implementations are also performed using technological advanced platforms such as computers. In fact, any computer processor that is operable to be programmed with the functionality of a runner and a blocker may be used to perform the game played in accordance with the present invention.

Moreover, when desired, any of the various traits and options of the GridBloc game performed in accordance with the present invention are predefined. For example, a default setting is used at certain times, thereby allowing a user to initiate a game very quickly without having to select each and every permutation possible. A user is able to store or save certain predefined settings for these default situations.

In view of the above detailed description of the present invention and associated drawings, other modifications and variations will now become apparent to those skilled in the art. It should also be apparent that such other modifications and variations may be effected without departing from the spirit and scope of the present invention.

What is claimed is:

1. A GridBloc strategy game method, comprising:

selecting a running trait for a running player;

selecting a blocking trait for a blocking player;

selecting a grid type for a GridBloc structure, the GridBloc structure having a plurality of tiles;

selecting a trait for the grid type;

selecting a game parameter, the game parameter governing an ending of the GridBloc strategy game;

wherein the running player runs among the plurality of tiles in a manner governed by the running trait;

the blocking player erects obstacles in a manner governed by the blocking trait within the GridBloc structure; and a score calculated from point values associated with the tiles of the plurality of tiles, wherein the score is based upon a number of unobstructed tiles available to the runner at the ending of the game.

2. A GridBloc strategy game, comprising:

a GridBloc structure, the structure comprising:

a plurality of tiles; and a plurality of walls that restrict the movement of a runner who moves among selected tiles within the plurality of tiles; and a blocker who erects additional walls to further restrict the movement of the runner within the GridBloc structure, wherein a score is based upon a number of unobstructed tiles available to the runner at the end of the game.

3. A GridBloc strategy game, comprising:

a grid type for a GridBloc structure, the GridBloc structure having a plurality of tiles;

a running player who moves among the plurality of tiles;

a blocking player who erects obstacles to the running player; and a score calculated from point values associated with the tiles of the plurality of tiles, wherein the score is based upon a number of unobstructed tiles available to the runner at the end of the game.

4. The GridBloc strategy game method of claim 1, wherein the running by the running player and erection of obstacles by the blocking player are performed sequentially.

5. The GridBloc strategy game method of claim 1, wherein the running by the running player and erection of obstacles by the blocking player are performed simultaneously.

6. The GridBloc strategy game of claim 2, further comprising:

one or more selectable running traits corresponding to the running player; and one or more selectable blocking trait corresponding to the blocking player.

7. The GridBloc strategy game of claim 2, further comprising:

a selectable game parameter governing an ending to the GridBloc strategy game.

8. The GridBloc strategy game of claim 2, wherein at the beginning of the game the GridBloc structure does not have an erected wall.

9. The GridBloc strategy game of claim 3, further comprising:

one or more selectable running traits corresponding to the running player; and one or more selectable blocking traits corresponding to the blocking player.

10. The GridBloc strategy game of claim 3, further comprising:

a selectable game parameter governing an ending to the GridBloc strategy game.

* * * * *